US007377839B2

(12) United States Patent
Schrottner

(10) Patent No.: US 7,377,839 B2
(45) Date of Patent: May 27, 2008

(54) COVER FOR GUIDING A MEDIUM IN AN ABRASIVE DISK

(76) Inventor: Gerhard Schrottner, Kleingaisfeld 163, A-8564 Krottendorf-Gaisfeld (AT)

( * ) Notice: Subject to any disclaimer, the term of this patent is extended or adjusted under 35 U.S.C. 154(b) by 0 days.

(21) Appl. No.: 10/570,396

(22) PCT Filed: Sep. 6, 2004

(86) PCT No.: PCT/EP2004/009898

§ 371 (c)(1),
(2), (4) Date: Nov. 1, 2006

(87) PCT Pub. No.: WO2005/023489

PCT Pub. Date: Mar. 17, 2005

(65) Prior Publication Data

US 2007/0190915 A1 Aug. 16, 2007

(30) Foreign Application Priority Data

Sep. 4, 2003 (AT) ..... A 1389/2003

(51) Int. Cl.
*B24B 55/02* (2006.01)

(52) U.S. Cl. ..... 451/450; 451/451; 451/488; 451/541

(58) Field of Classification Search ..... 451/449, 451/450, 451, 488, 541
See application file for complete search history.

(56) References Cited

U.S. PATENT DOCUMENTS

| | | | | |
|---|---|---|---|---|
| 2,470,350 | A | 5/1949 | Harrington | |
| 3,777,443 | A | 12/1973 | Shaw | |
| 5,423,717 | A | 6/1995 | Boaz | |
| 5,846,125 | A | 12/1998 | Robichon | |
| 5,993,297 | A * | 11/1999 | Hyatt et al. | 451/53 |
| 6,739,960 | B2 * | 5/2004 | Sauer | 451/449 |
| 6,966,826 | B2 * | 11/2005 | Suzuki et al. | 451/450 |

FOREIGN PATENT DOCUMENTS

| | | |
|---|---|---|
| DE | 1 502 607 | 6/1969 |

* cited by examiner

*Primary Examiner*—Eileen P. Morgan
(74) *Attorney, Agent, or Firm*—Andrew Wilford

(57) ABSTRACT

The invention relates to a grinding-wheel cover (3) for grinding wheels with a support body (1) and a grinding layer (2) arranged at an edge or face for edge or face use in grinding, a grinding-wheel cover being provided for forming cavities on the grinding body, wherein the grinding-wheel cover (3) additionally being provided with partitions, recesses or cutouts (5) for increasing the pressure of the cooling and or lubricating medium.

7 Claims, 4 Drawing Sheets

COVER FOR GUIDING A MEDIUM IN AN ABRASIVE DISK

CROSS REFERENCE TO RELATED APPLICATIONS

This application is the U.S. national phase of PCT application PCT/EP2004/009898, filed 6 Sep. 2004, published 17 Mar. 2005 as WO 2005/023489, and claiming the priority of Austrian patent application A1389/2003 itself filed 4 Sep. 2003, whose entire disclosures are herewith incorporate by reference.

FIELD OF THE INVENTION

The invention relates to a cover for a grinding wheel with a support body and a grinding layer mounted on an edge or face for edge or face grinding. Whenever a workpiece, independent of its structure and of its grinding layer, is being ground there are high temperatures in the work area of the grinding tool that can be controlled with a cooling and lubricating medium.

OBJECT OF THE INVENTION

Therefore, it is the object of the invention to improve the cooling and lubrication even of grinding wheels used to date without significant refitting costs.

SUMMARY OF THE INVENTION

This object is achieved in that the cover for the formation of cavities is provided with further partitions, recesses or cutouts that receive the cooling and lubricating medium at the center of the wheel and convey it to the necessary points of application during the grinding process. By means of this conveying system for the cooling and lubricating medium, the medium can be more directly fed to the points of application. In addition both the grinding body and the grinding wheel holder are cooled more uniformly and more effectively. This results in better grinding and a higher quality workpiece as well as increased grinding-tool life.

In other words, the instant invention is a grinding wheel having a support body centered on and rotatable about an axis and having an axially directed face surface and a radially outwardly directed edge surface and a grinding layer fixed to one of the surfaces of the body. A cover ring fixed to the face surface of the body forms a single intake and a plurality of radially extending cavities opening radially inward and dimensioned to compress and feed radially outward a liquid medium fed to the intake while the wheel is rotating about its axis.

The grinding-wheel cover can be composed of widely varied materials and produced in the different processing and machining procedures (e.g. cutting, machining, casting). This grinding-wheel cover with its central opening serves for the creation of a cavity and thus for the medium inlet into the inner body of the grinding wheel constructing. The grinding-wheel cover is provided with partitions, recesses or cutouts which increase the pressure of the cooling and lubricating medium within the grinding wheel and force the medium to assume the angular speed of the grinding wheel. Thus, an unbalance caused by a swashing medium is avoided. The medium is transported to the designated point of application by means of bores, openings or recesses in the grinding body and in the grinding layer. The grinding-wheel cover can be detachably or non-detachably connected to the grinding-wheel body, for example by welding, soldering, bolting, gluing or by means of retaining rings.

By means of the invention, known and in-use grinding wheels can be improved without large modification efforts when produced or when installed later, particularly regarding improved grinding characteristics, longer operational life, less machine downtime, less machining time, improved repeating exactness and reduced heating of the grinding wheel and the workpiece as well as improved surface quality of the workpiece. Thanks to the improved lubricating and cooling effect there are no structural modifications regarding the processed materials.

BRIEF DESCRIPTION OF THE DRAWING

The drawing shows an illustrated embodiment of the object of the invention.

SPECIFIC DESCRIPTION

Figure 1:
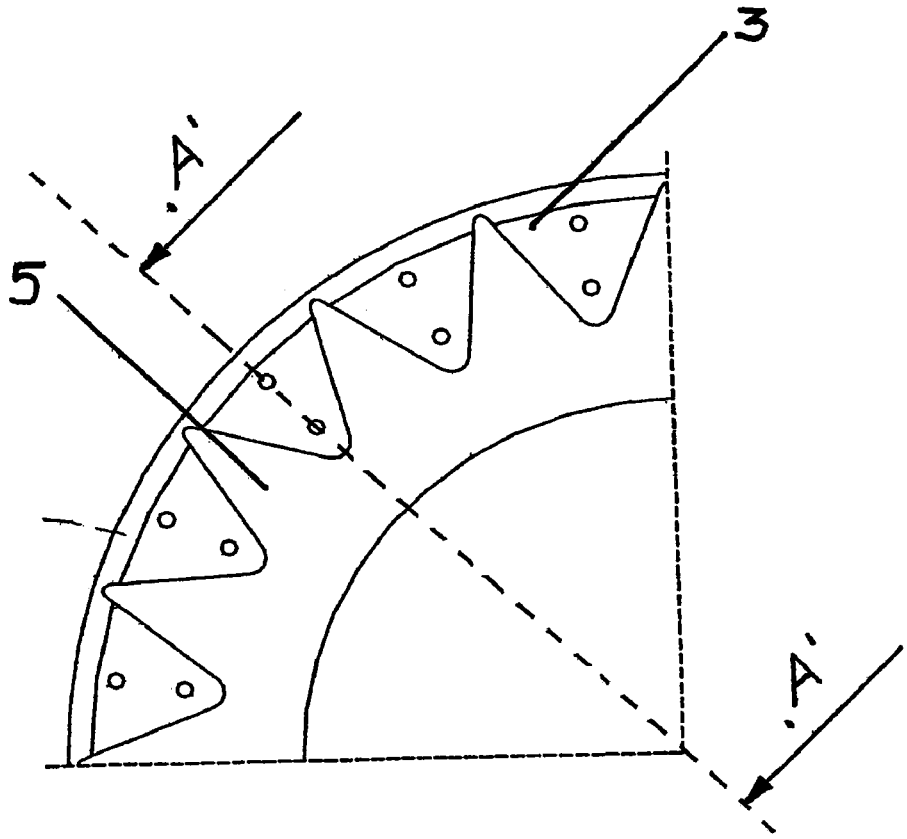
FIG. 1 shows a detailed view of the grinding-wheel cover for an edge-type grinding wheel.
Figure 2:
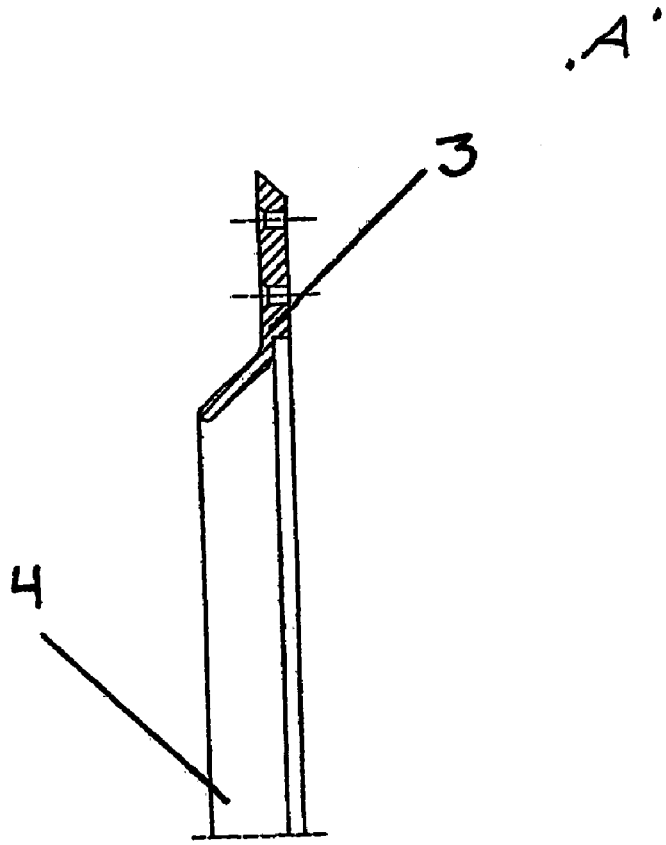
FIG. 2 shows a section according to line A of FIG. 1.
Figure 3:
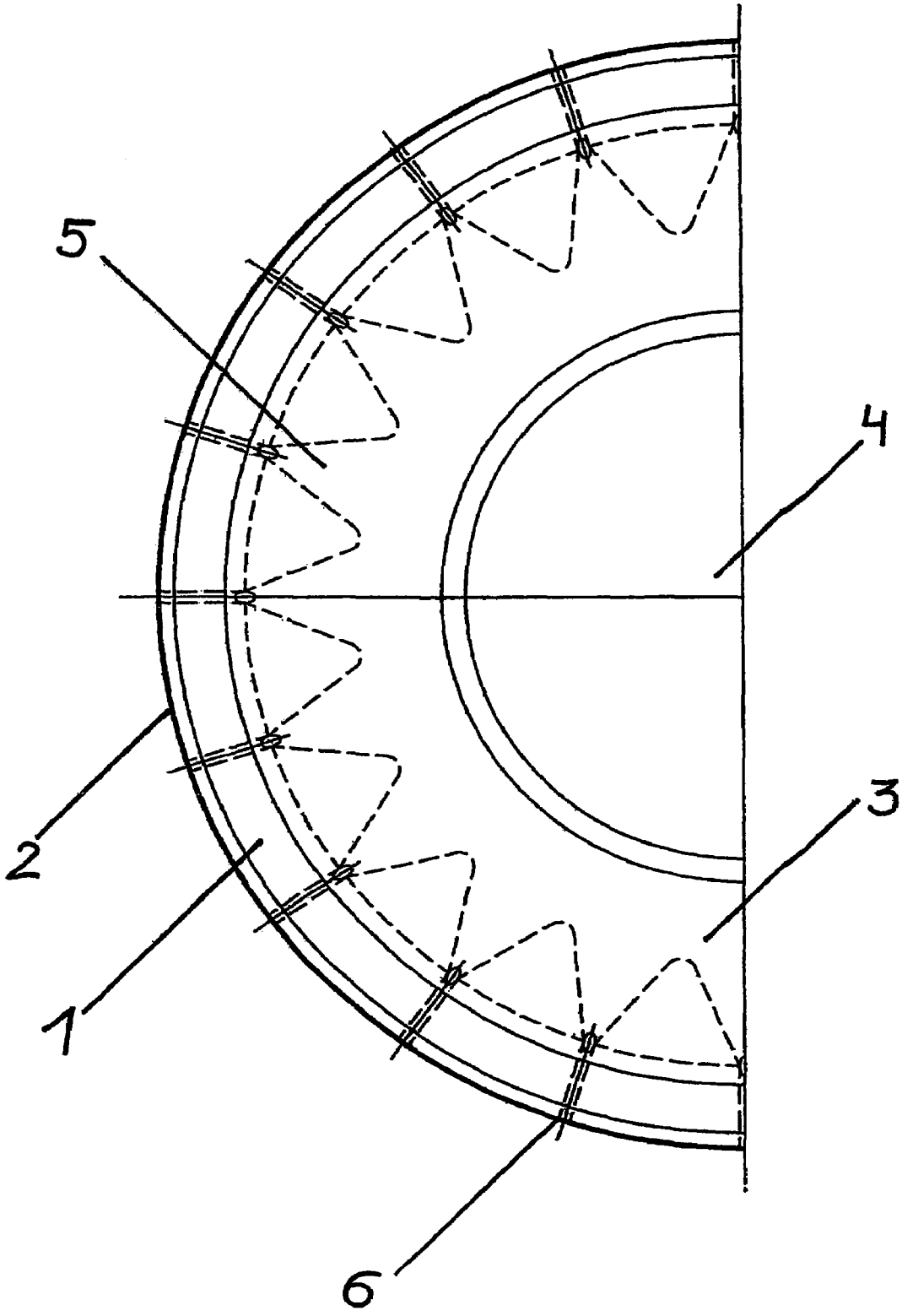
FIG. 3 shows a detailed view of a grinding wheel with a mounted grinding-wheel cover with a possible design of the recesses on the grinding-wheel cover. Furthermore, a possible design of the bores for the medium discharge in the grinding body and grinding layer is illustrated.
Figure 4:
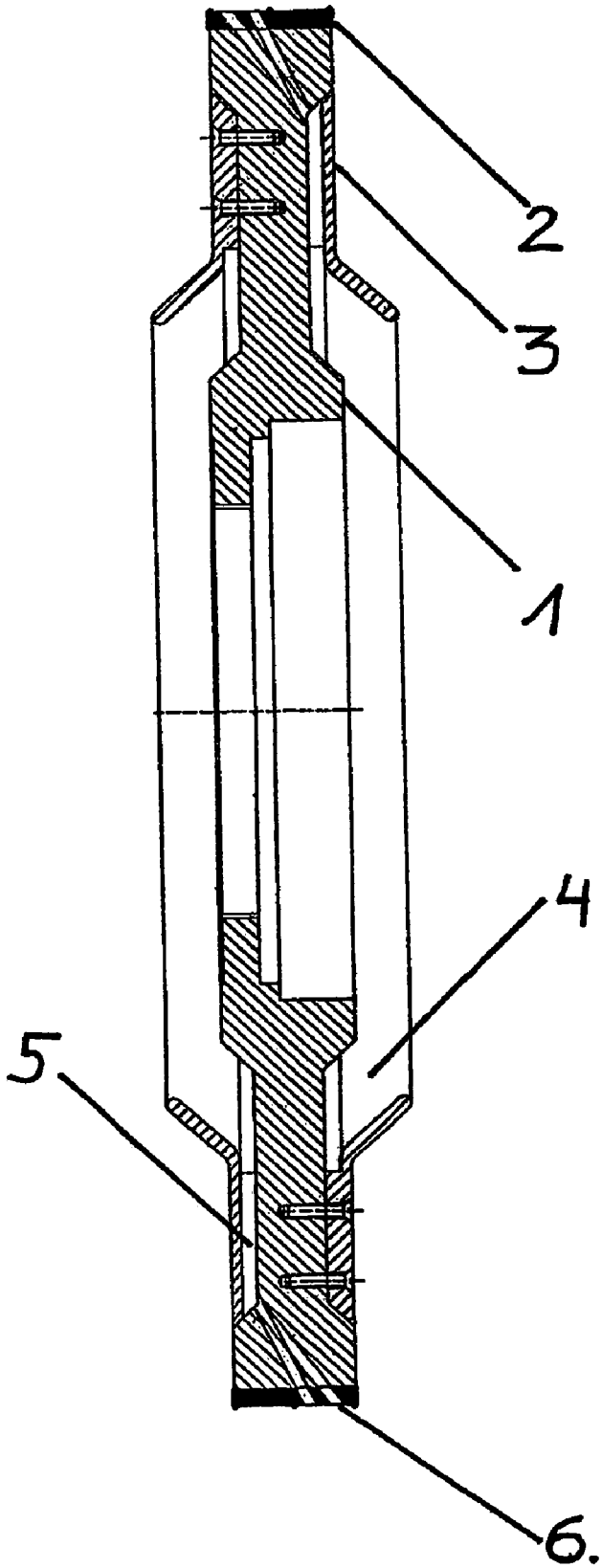
FIG. 4 shows a longitudinal section through an edge-type grinding wheel with the grinding-wheel cover according to the invention mounted thereon. Furthermore a possible design of the bores for the medium discharge in the grinding body and grinding layer is illustrated.

The grinding wheel, consisting of a support body 1 and a grinding layer 2, as well as of the grinding-wheel cover 3, by the central intake opening 4 of which the medium gets into the grinding wheel. By partitions, recesses or cutouts 5 the medium is forced to assume the angular speed of the grinding wheel and the medium is conveyed to the point of application via discharge bores 6 in the grinding body and in the grinding layer.

The invention claimed is:

1. A grinding wheel comprising:

a support body centered on and rotatable about an axis and having an axially directed face surface and a radially outwardly directed edge surface and an array of bores extending radially inward from one of the surfaces;

a grinding layer fixed to one of the surfaces of the body; and a cover ring fixed to the face surface of the body and forming a single intake opening and a plurality of radially extending cavities opening radially inward, and connected to the bores dimensioned to increase pressure of and feed radially outward a liquid medium fed to the intake while the wheel is rotating about its axis, and shaped to force the medium to assume the same angular speed as the body.

2. The grinding wheel defined in claim 1 wherein the intake opens radially inward.

3. The grinding wheel defined in claim 1 wherein the ring has an inner edge forming the intake formed with a bent-out lip.

4. The grinding wheel defined in claim 1 wherein the cavities are of flow cross section that decreases radially outward.

5. The grinding wheel defined in claim 4 wherein the cavities are distributed angularly uniformly about the axis.

6. The grinding wheel defined in claim 4 wherein the body is formed with respective radially extending bores having inner ends opening into the cavities and outer ends opening at the one surface.

7. A grinding wheel comprising:

a disk-shaped support body centered on and rotatable about an axis, having an axially directed face surface and a radially outwardly directed edge surface, and formed with an array of angularly equispaced and radially extending bores each having a radial outer end opening at one of the surfaces and a radial inner end;

a grinding layer fixed to the one surface of the body; and a cover ring fixed to the face surface of the body and forming a single radially inwardly open intake and a plurality of radially extending and angularly equispaced cavities opening radially inward and connected to the cores at the intake, of cross-sectional size decreasing radially outward, and connected to the inner ends of the bores, whereby liquid fed to the intake while the wheel is rotating about the axis is driven outward through the cavities and respective bores and is pressurized increasingly radially outward, the cavities and bores being shaped so as to force the medium to assume the same angular speed as the body.

* * * * *